US007040243B1

(12) United States Patent
Chang

(10) Patent No.: US 7,040,243 B1
(45) Date of Patent: May 9, 2006

(54) BODY STRUCTURE FOR SEWING MACHINE

(76) Inventor: Tseng Hsien Chang, 9F, No. 270, Gaogong Rd., South District, Taichung City 402 (TW)

( * ) Notice: Subject to any disclaimer, the term of this patent is extended or adjusted under 35 U.S.C. 154(b) by 0 days.

(21) Appl. No.: 11/004,924

(22) Filed: Dec. 7, 2004

(51) Int. Cl.
*D05B 73/02* (2006.01)

(52) U.S. Cl. ..... 112/258

(58) Field of Classification Search ..... 112/258, 112/259, 260, 220, 284, 217.1
See application file for complete search history.

(56) References Cited

U.S. PATENT DOCUMENTS 418,890 A * 1/1890 Dimond et al. ..... 112/220
2,987,021 A * 6/1961 Meier ..... 112/258
3,347,196 A * 10/1967 Leslie ..... 112/258
3,673,972 A * 7/1972 Grange ..... 112/258
4,220,103 A * 9/1980 Kasahara et al. ..... 112/260
4,429,650 A * 2/1984 Ishikawa et al. ..... 112/258
5,140,918 A * 8/1992 Combepine et al. ..... 112/258
6,843,188 B1 * 1/2005 Sakakibara et al. ..... 112/220

* cited by examiner

*Primary Examiner*—Ismael Izaguirre
(74) *Attorney, Agent, or Firm*—Rosenberg, Klein & Lee

(57) ABSTRACT

A sewing machine includes a base portion with an upright portion connected thereto and a hollow horizontal portion connected to the upright portion. At least two reinforcement members are received therein and each of the at least two reinforcement members has a through hole for a shaft extending therethrough. The shaft is connected to a needle assembly. An end adjusting member and a side adjusting member are respectively connected to the horizontal portion and the needle bar of the needle assembly is movably connected to the end adjusting member. The side adjusting member can be adjusted in horizontal direction and the end adjusting member can be adjusted in vertical direction.

13 Claims, 3 Drawing Sheets

BODY STRUCTURE FOR SEWING MACHINE

FIELD OF THE INVENTION

The present invention relates to a sewing machine including hollow horizontal arm in which reinforcement members are received and the shaft rotatably extends through the reinforcement members.

BACKGROUND OF THE INVENTION

A conventional body of a sewing machine is made by way of casting and the body generally is heavy and needs further steps of machining for obtaining a desired outer appearance. This is a time-consuming job and the size of the body can not be controlled to be precise. Although some manufacturers use aluminum alloy to make the body of the sewing machine, high cost of the material and molds are main concern for the customers.

The present invention intends to provide a body of the sewing machine wherein the base portion, the upright portion and the horizontal portion are made to be hollow and reinforcement members are engaged with the horizontal portion so as to have a light and strong body.

SUMMARY OF THE INVENTION

The present invention relates to a sewing machine that includes a base portion with an upright portion which is connected to a horizontal portion which is a hollow member and at least two reinforcement members are received therein. Each of the at least one reinforcement members has a through hole and a shaft extends through the through holes of the at least one reinforcement members. A needle assembly is connected to the shaft.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
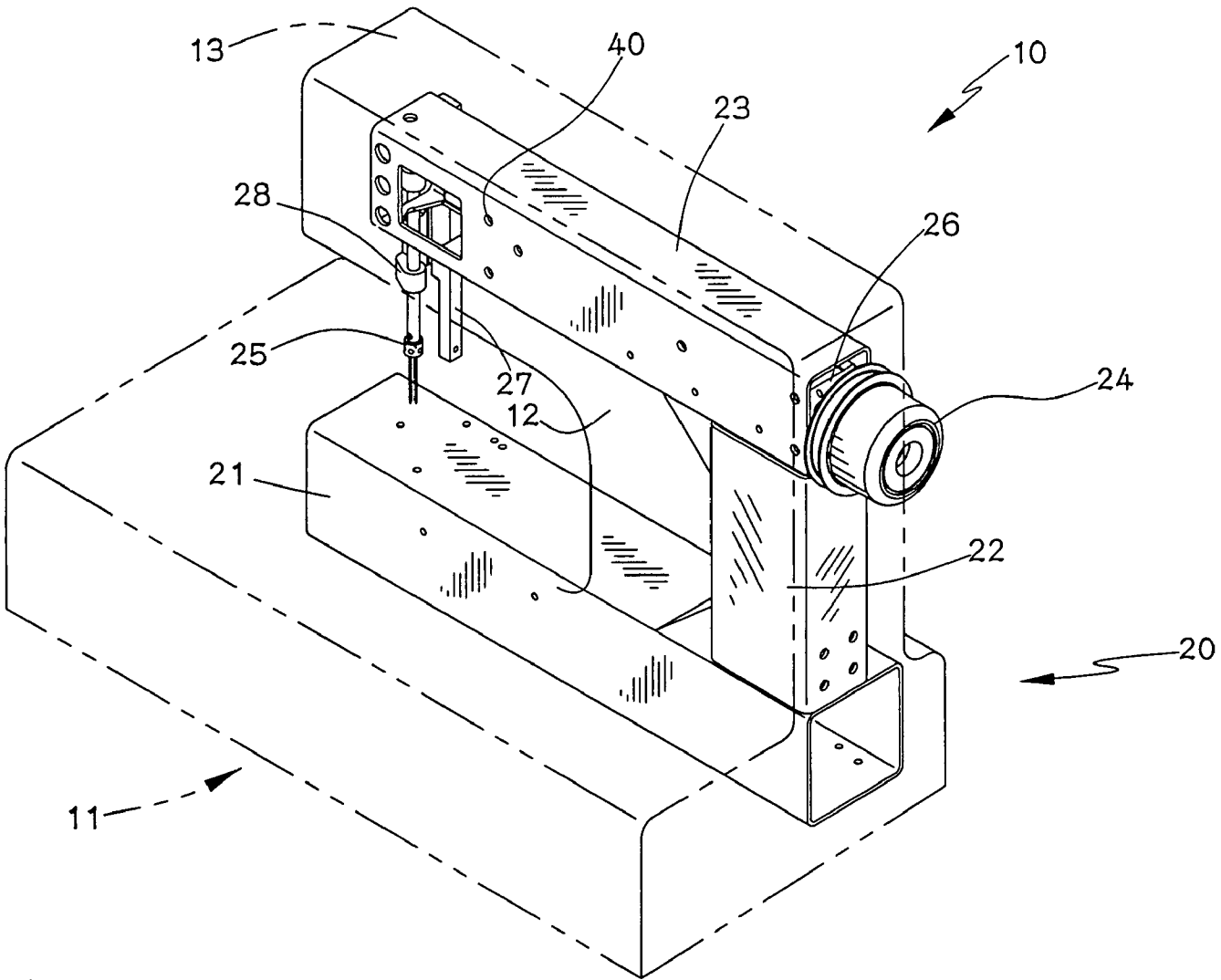
FIG. 1 is a perspective view of the sewing machine of the present invention.
Figure 2:
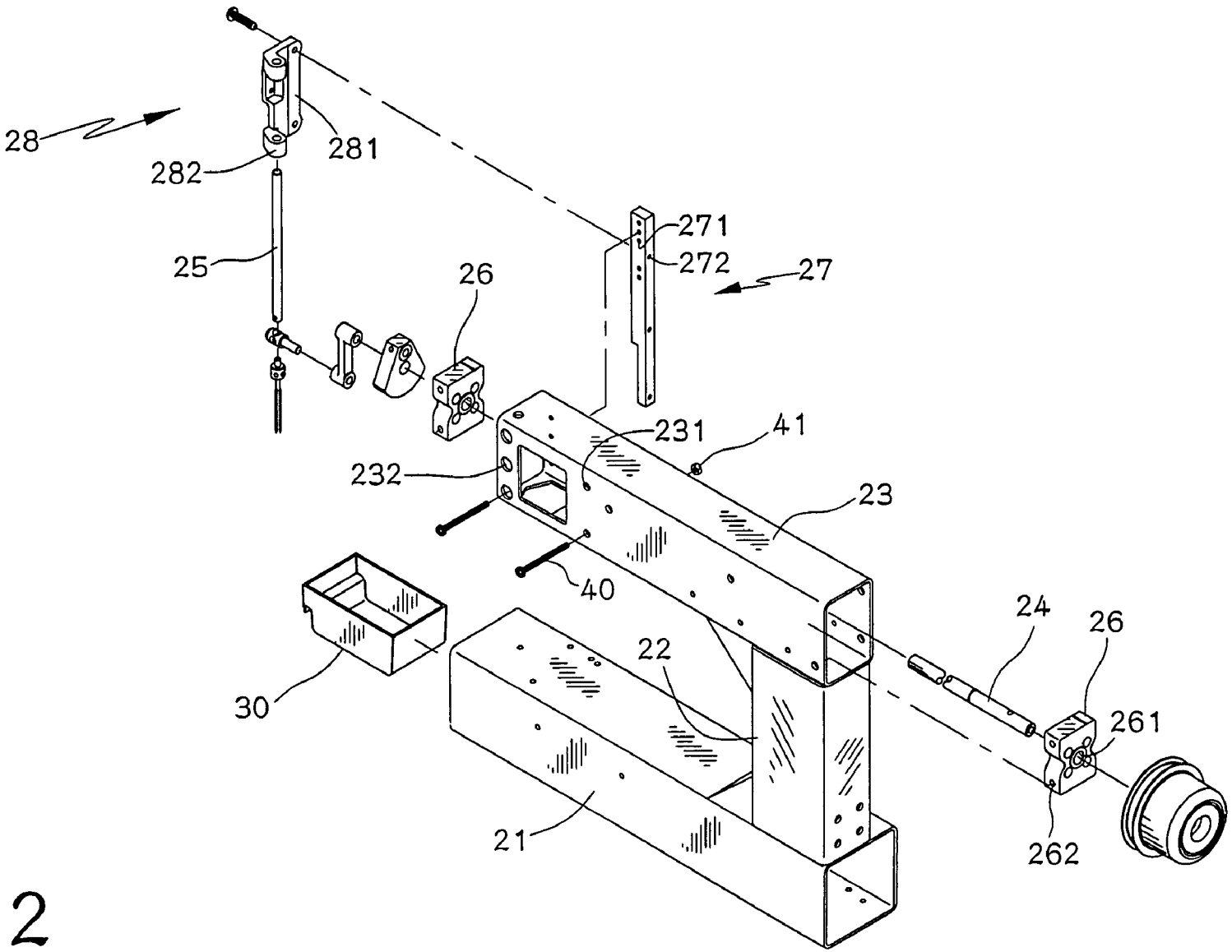
FIG. 2 is an exploded view to show the sewing machine of the present invention.
Figure 4:
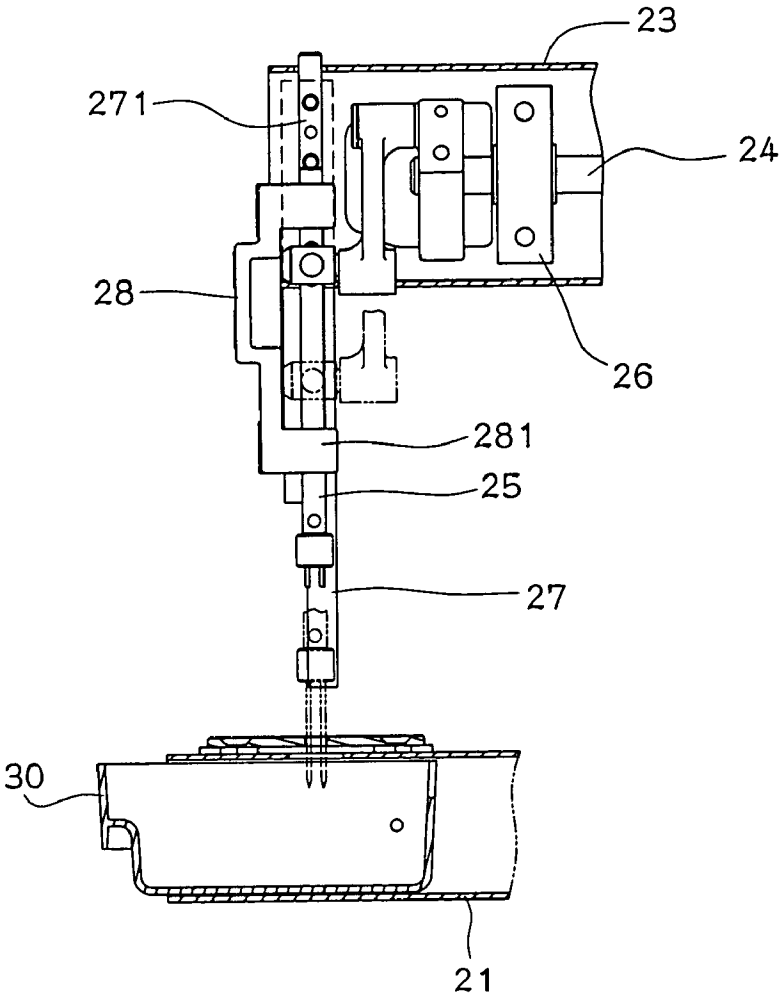
FIG. 4 is a side view to show the end adjusting member and the side adjusting member connected to the sewing machine of the present invention.
Figure 3:
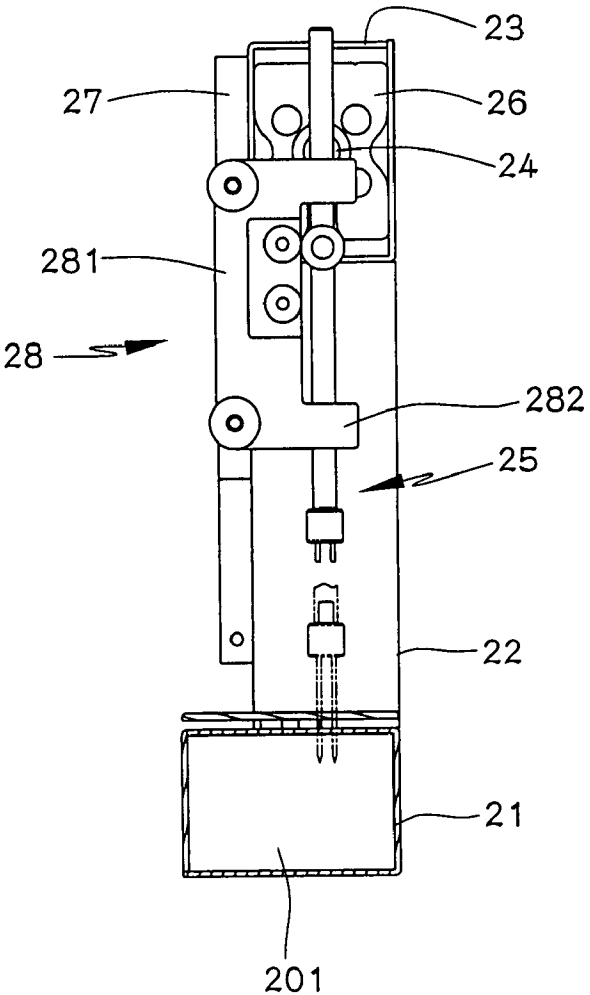
FIG. 3 is an end view to show the end adjusting member and the side adjusting member connected to the sewing machine of the present invention.

Referring to FIGS. 1 to 4, the sewing machine 10 of the present invention comprises a base casing 11 with an upright casing 12 connected thereto and a horizontal casing 13 connected to the upright casing 12. A body 20 of the sewing machine is enclosed in the casing and includes a base portion 21 in the base casing 11, an upright portion 22 located in the upright casing 12 and connected to the base portion 21, and a horizontal portion 23 connected to the upright portion 22 and located in the horizontal casing 13. The horizontal portion 23 is a hollow member and at least one reinforcement members 26 are received therein so as to form a reinforcement structure. Each of the at least one reinforcement members 26 has a through hole 261 and a shaft 24 extends through the through holes 261 of the at least one reinforcement members 26. A needle assembly 25 including a needle bar 25 is connected to the shaft 24.

Each of the at least one reinforcement members 26 includes at least two side holes 262 and fixing holes 231 are defined through opposite walls of the horizontal portion 23 so that screws 40 extend through the fixing holes 231 and the at least two side holes 262 and are fixed by cooperation with nuts 41 to fix the at least one reinforcement members 26 in the horizontal portion 23.

An end adjusting member 28 is located at an end of the horizontal portion 23 and includes two ring-shaped members 282 through which the needle bar 25 of the needle assembly movably extends. The end adjusting member 28 is connected to a side adjusting member 27 which is connected to a rear surface of the horizontal portion 23. The side adjusting member 27 includes a plurality of first positioning holes 271 and the horizontal portion 23 includes a plurality of adjusting holes 232 which are larger than the first positioning holes 271 in the side adjusting member 27. It is noted that the adjusting holes 232 in the horizontal portion 23 are larger than the first positioning holes 271 in the side adjusting member 27 in horizontal direction so that the side adjusting member 27 is allowed to move slightly in the horizontal direction. The side adjusting member 27 includes second position holes 272 defined in a side perpendicular to a side having the first adjusting holes 271, and the end adjusting member 28 includes third positioning holes 281 such that the side adjusting member 27 is connected to the end adjusting member 28 by extending bolts through the alignment second and third positioning holes 272, 281. The third positioning holes 281 are larger than the second positioning holes 272 in vertical direction, so that the end adjusting member 28 is allowed to slight move in vertical direction. In other words, the user may adjust the needle bar 25 in four directions by operating the side adjusting member 27 and the end adjusting member 28. The base portion 21 is a hollow member and a collection box 30 is slidably inserted into an open end of the base portion 21.

The structural strength of the body 20 of the sewing machine 10 is improved by using the reinforcement member 26 which are fixed and in contact with the insides of the horizontal portion 23 by screws 40 so that the sewing machine 10 can be made to be light and strong. The shaft 24 is well supported by the reinforce members 26 and allowed to be precisely installed to the sewing machine 10. The adjustability of the needle bar 25 in four directions allows the body 20 to have wider range of tolerance and this reduces the cost for having precise molds.

While we have shown and described the embodiment in accordance with the present invention, it should be clear to those skilled in the art that further embodiments may be made without departing from the scope of the present invention.

What is claimed is:

1. A sewing machine, comprising:

a base portion with an upright portion connected thereto and a horizontal portion connected to the upright portion, the horizontal portion being a hollow member and at least two reinforcement members received therein, each of the at least two reinforcement members having a through hole and a shaft extending through the through holes of the at least two reinforcement members, a needle assembly connected to the shaft; and an end adjusting member located at an end of the horizontal portion and the needle assembly being movably connected to the end adjusting member, the end adjusting member being connected to a side adjusting member which is connected to a rear surface of the horizontal portion, the side adjusting member including a plurality of first positioning holes and the horizontal portion including a plurality of adjusting holes which are larger than the first positioning holes in the side adjusting member.

2. The sewing machine as claimed in claim 1, wherein each of the at least two reinforcement members includes at least two side holes and screws extend through fixing holes defined through opposite walls of the horizontal portion and the at least two side holes to fix the at least two reinforcement members in the horizontal portion.

3. The sewing machine as claimed in claim 1, wherein the base portion is a hollow member and a collection box is slidably inserted into an open end of the base portion.

4. The sewing machine as claimed in claim 1, wherein the adjusting holes in the horizontal portion are larger than the first positioning holes in the side adjusting member in horizontal direction.

5. The sewing machine as claimed in claim 1, wherein the side adjusting member includes second position holes defined in a side perpendicular to a side having the first adjusting holes, the end adjusting member includes third positioning holes such that the side adjusting member is connected to the end adjusting member by extending bolts through the alignment second and third positioning holes.

6. The sewing machine as claimed in claim 5, wherein the third positioning holes are larger than the second positioning holes in vertical direction.

7. A sewing machine, comprising:

a base portion with an upright portion connected thereto and a horizontal portion connected to the upright portion, a shaft extending through the horizontal portion and connected to a needle assembly, and an end adjusting member located at an end of the horizontal portion and the needle assembly movably connected to the end adjusting member, the end adjusting member connected to a side adjusting member which is connected to a rear surface of the horizontal portion, the side adjusting member including a plurality of first positioning holes and the horizontal portion includes a plurality of adjusting holes which are larger than the first positioning holes in the side adjusting member.

8. The sewing machine as claimed in claim 7, wherein the adjusting holes in the horizontal portion are larger than the first positioning holes in the side adjusting member in horizontal direction.

9. The sewing machine as claimed in claim 7, wherein the side adjusting member includes second position holes defined in a side perpendicular to a side having the first adjusting holes, the end adjusting member includes third positioning holes such that the side adjusting member is connected to the end adjusting member by extending bolts through the alignment second and third positioning holes.

10. The sewing machine as claimed in claim 9, wherein the third positioning holes are larger than the second positioning holes in vertical direction.

11. The sewing machine as claimed in claim 7, wherein the base portion is a hollow member and a collection box is slidably inserted into an open end of the base portion.

12. The sewing machine as claimed in claim 7, wherein the horizontal portion is a hollow member and at least two reinforcement members are received therein, each of the at least two reinforcement members having a through hole and the shaft extending through the through holes of the at least two reinforcement members.

13. The sewing machine as claimed in claim 12, wherein each of the at least two reinforcement members includes at least two side holes and screws extend through fixing holes defined through opposite walls of the horizontal portion and the at least two side holes to fix the at least two reinforcement members in the horizontal portion.

* * * * *